US010699840B2

(12) United States Patent
Sung et al.

(10) Patent No.: US 10,699,840 B2
(45) Date of Patent: Jun. 30, 2020

(54) THERMAL MANAGEMENT SYSTEM FOR VEHICLE POWER INDUCTOR ASSEMBLY

(71) Applicant: Ford Global Technologies, LLC, Dearborn, MI (US)

(72) Inventors: Myung Ki Sung, Ypsilanti, MI (US); Edward Chan-Jiun Jih, Troy, MI (US); Michael W. Degner, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 78 days.

(21) Appl. No.: 15/810,666

(22) Filed: Nov. 13, 2017

(65) Prior Publication Data

US 2019/0148054 A1 May 16, 2019

(51) Int. Cl.

| | |
|---|---|
| ***H01F 27/10*** | (2006.01) |
| ***H01F 27/28*** | (2006.01) |
| ***H01F 37/00*** | (2006.01) |
| ***H01F 27/40*** | (2006.01) |

(52) U.S. Cl.

CPC ..... *H01F 27/2876* (2013.01); *H01F 27/10* (2013.01); *H01F 27/402* (2013.01); *H01F 37/00* (2013.01); *H01F 2027/406* (2013.01)

(58) Field of Classification Search

CPC .... H01F 27/2876; H01F 27/02; H01F 27/025; H01F 27/008; H01F 27/10; H01F 27/12; H01F 27/125; H01F 27/402; H01F 2027/406; H01F 37/00

USPC ..... 336/57, 90, 58, 212

See application file for complete search history.

(56) References Cited

U.S. PATENT DOCUMENTS

| | | | | |
|---|---|---|---|---|
| 7,129,808 | B2 | 10/2006 | Roebke et al. | |
| 7,508,289 | B1 | 3/2009 | Wernicki | |
| 8,570,132 | B2 | 10/2013 | Doo et al. | |
| 8,816,808 | B2 | 8/2014 | MacLennan et al. | |
| 9,373,436 | B2 | 6/2016 | Pal | |
| 2013/0300528 | A1* | 11/2013 | Nobusaka | H01F 3/14 336/90 |
| 2014/0175867 | A1* | 6/2014 | Sung | F16H 57/0412 307/9.1 |
| 2016/0027568 | A1* | 1/2016 | Takauchi | H01F 37/00 336/60 |

FOREIGN PATENT DOCUMENTS

| | | | |
|---|---|---|---|
| JP | 56107523 A | * | 8/1981 |
| JP | 59159512 A | * | 9/1984 |

* cited by examiner

*Primary Examiner* — Mang Tin Bik Lian

(74) *Attorney, Agent, or Firm* — David Kelley; Brooks Kushman, P.C.

(57) ABSTRACT

A power inductor assembly including a power inductor, a vehicle component, and a pair of distribution conduits is provided. The power inductor has a housing supporting a pair of coils. The vehicle component is located above the pair of coils. Each of the pair of distribution conduits is oriented relative to one of the pair of coils below the vehicle component and has one or more openings adjacent the coils to distribute coolant thereto. Each of the one or more openings may define one of a circular shape or a slot shape. Each of the one or more openings may be sized such that exiting coolant substantially uniformly covers the adjacent coil.

18 Claims, 7 Drawing Sheets

THERMAL MANAGEMENT SYSTEM FOR VEHICLE POWER INDUCTOR ASSEMBLY

TECHNICAL FIELD

This disclosure relates to thermal management systems for vehicle power inductors.

BACKGROUND

Coils of vehicle inductors generate heat during operation. This heat results in power losses of the vehicle inductors. Known inductor thermal management systems rely on a thermal plate to assist in managing thermal conditions of vehicle inductors. However, these systems may not be optimally efficient and typically use a potting compound to transfer heat from the coils to the thermal plate in an indirect cooling scheme.

SUMMARY

A power inductor assembly includes a power inductor, a vehicle component, and a pair of distribution conduits. The power inductor has a housing supporting a pair of coils. The vehicle component is located above the pair of coils. Each of the pair of distribution conduits is oriented relative to one of the pair of coils below the vehicle component and has one or more openings adjacent the coils to distribute coolant thereto. Each of the one or more openings may define one of a circular shape and a slot shape. Each of the one or more openings may be sized such that exiting coolant substantially uniformly covers the adjacent coil. Each of the pair of the pair of distribution conduits may be spaced from one of the pair of coils a length approximately equal to half to five times a diameter of one of the one or more openings. The vehicle component may be one of a portion of a transmission case housing, a portion of a supporting fixture for an electric motor or generator, the power inductor, and a variable voltage controller housing. The power inductor may define a rectangular prism and each of the pair of coils may be located above the rectangular prism and below the vehicle component. The coolant may be one of engine oil, transmission oil, and engine coolant.

A power inductor assembly includes a power inductor and two distribution conduits. The power inductor includes a housing supporting a pair of coils. Each of the two distribution conduits are oriented vertically relative to the coils. Each of the distribution conduits is arranged with one of the coils such that coolant exiting the distribution conduit covers a first predetermined area of one of the pair of coils. The first predetermined area is further defined as an area substantially uniformly covering one of the pair of coils. The assembly may further include a third distribution conduit and a fourth distribution conduit. The third distribution conduit may be spaced from one of the two distribution conduits and oriented vertically relative to one of the pair of coils for coolant distribution thereupon. The fourth distribution conduit may be spaced from an other of the two distribution conduits and oriented vertically relative to the other of the pair of coils for coolant distribution thereupon. The assembly may further include a coolant pump, a sensor, and a controller. The coolant pump may be in fluid communication with one of the two distribution conduits. The sensor may be in communication with one of the pair of coils to monitor thermal conditions thereof. The controller may be in communication with the sensor to receive signals including the monitored thermal conditions and in communication with the coolant pump to direct operation thereof based on the monitored thermal conditions. The assembly may include an attachment sized for mounting to an end of one of the distribution conduits including a channel in fluid communication with the one of the distribution conduits and one or more openings in fluid communication with the channel to disperse coolant about one of the pair of coils to cover a second predetermined area greater than the first predetermined area. The assembly may include a cap sized for mounting to an end of one of the distribution conduits including a channel shaped to spread coolant traveling therethrough and exiting the distribution conduit. The assembly may include a vehicle component. The pair of coils and the housing may be sized for locating within a rectangular prism and the vehicle component may be located outside of the rectangular prism. The distribution conduits may be arranged with the vehicle component to provide the coolant to the pair of coils without contacting the vehicle component.

A power inductor assembly includes a power inductor and an inductor thermal management system. The power inductor includes a pair of coils to generate energy to assist in powering a vehicle. The inductor thermal management system includes a coolant circuit in fluid communication with a pair of distribution conduits each spaced above one of the pair of coils. Each of the pair of distribution conduits defines an opening for delivering coolant directly upon one of the pair of coils and is spaced away from a respective one of the coils. Each of the pair of distribution conduits may be oriented vertically relative to one of the pair of coils such that each of the openings is arranged with the one of the pair of coils to distribute coolant substantially uniformly thereupon. Each of the pair of distribution conduits may be oriented vertically relative to one of the pair of coils such that clearance is provided for locating a vehicle component on an outer side of each of the distribution conduits and above the pair of coils. Each of the pair of distribution conduits may be oriented horizontally relative to one of the pair of coils such that each of the openings is arranged with the one of the pair of coils to distribute coolant substantially uniformly thereupon. Each of the pair of distribution conduits may be oriented horizontally relative to one of the pair of coils to provide space for locating a vehicle component above the pair of distribution conduits and a rectangular prism region defined by the power inductor. The coolant may be one of engine oil, transmission oil, and engine coolant.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
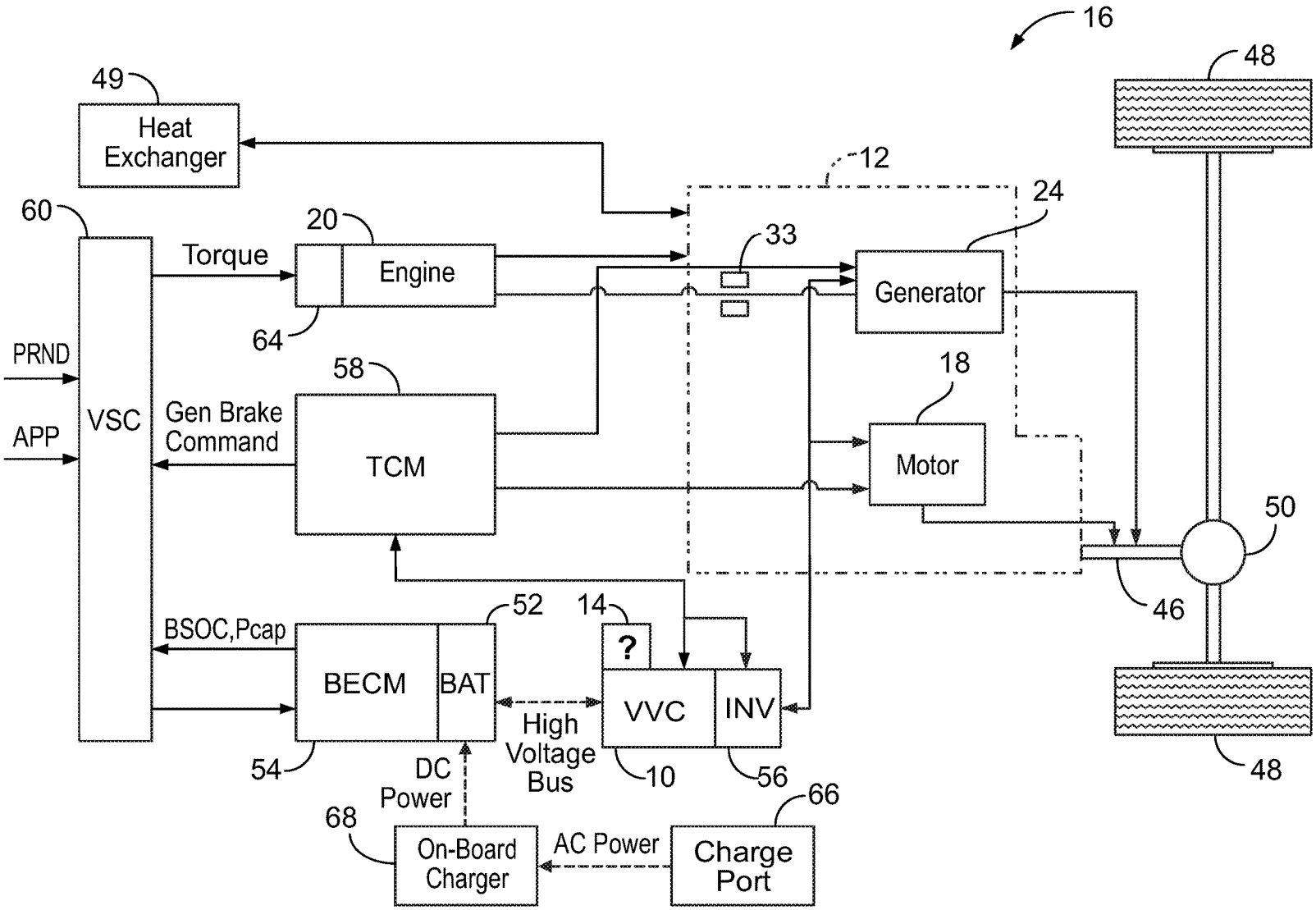
FIG. 1 is a schematic diagram of an example of an electrified vehicle.

FIG. 1 illustrates an example of an electrified vehicle, referred to generally as a vehicle 16 herein. The vehicle 16 may include a transmission 12 and is an example of an electric vehicle propelled by an electric machine 18 with assistance from an internal combustion engine 20. The vehicle 16 may be connectable to an external power grid. The electric machine 18 may be an AC electric motor depicted as a motor 18 in FIG. 1. The electric machine 18 receives electrical power and provides torque for vehicle propulsion. The electric machine 18 may also function as a generator for converting mechanical power into electrical power through regenerative braking.

The transmission 12 may be a power-split configuration. The transmission 12 may include the first electric machine 18 and a second electric machine 24. The second electric machine 24 may be an AC electric motor depicted as a generator 24 in FIG. 1. Similar to the first electric machine 18, the second electric machine 24 may receive electrical power and provide output torque. The second electric machine 24 may also operate as a generator for converting mechanical power into electrical power and optimizing power flow through the transmission 12. In other embodiments, the transmission may not have a power-split configuration.

The transmission 12 may include a planetary gear unit (not shown) and may operate as a continuously variable transmission and without any fixed or step ratios. The transmission 12 may also include a one-way clutch (O.W.C.) and a generator brake 33. The O.W.C. may be coupled to an output shaft of the engine 20 to control a direction of rotation of the output shaft. The O.W.C. may prevent the transmission 12 from back-driving the engine 20. The generator brake 33 may be coupled to an output shaft of the second electric machine 24. The generator brake 33 may be activated to "brake" or prevent rotation of the output shaft of the second electric machine 24 and of the sun gear 28. Alternatively, the O.W.C. and the generator brake 33 may be replaced by implementing control strategies for the engine 20 and the second electric machine 24. The transmission 12 may be connected to a driveshaft 46. The driveshaft 46 may be coupled to a pair of drive wheels 48 through a differential 50. An output gear (not shown) of the transmission may assist in transferring torque between the transmission 12 and the drive wheels 48. The transmission 12 may also be in communication with a heat exchanger 49 or an automatic transmission fluid cooler (not shown) for cooling the transmission fluid.

The vehicle 16 includes an energy storage device, such as a traction battery 52 for storing electrical energy. The battery 52 may be a HV battery capable of outputting electrical power to operate the first electric machine 18 and the second electric machine 24 as further described below. The battery 52 may also receive electrical power from the first electric machine 18 and the second electric machine 24 when they are operating as generators. The battery 52 may be a battery pack made up of several battery modules (not shown), where each battery module contains a plurality of battery cells (not shown). Other embodiments of the vehicle 16 contemplate alternative types of energy storage devices, such as capacitors and fuel cells (not shown) that may supplement or replace the battery 52.

A high voltage bus may electrically connect the battery 52 to the first electric machine 18 and to the second electric machine 24. For example, the vehicle 16 may include a battery energy control module (BECM) 54 for controlling the battery 52. The BECM 54 may receive input indicative of certain vehicle conditions and battery conditions, such as battery temperature, voltage, and current. The BECM 54 may calculate and estimate parameters of the battery 52, such as a battery state of charge (BSOC) and a battery power capability (Pcap). The BECM 54 may provide output that is indicative of the BSOC and Pcap to other vehicle systems and controllers.

The vehicle 16 may include a DC-DC converter or variable voltage converter (VVC) 10 and an inverter 56. The VVC 10 and the inverter 56 may be electrically connected between the battery 52 and the first electric machine 18 and the second electric machine 24. The VVC 10 may "boost" or increase a voltage potential of electrical power provided by the battery 52. The VVC 10 may also "buck" or decrease voltage potential of the electrical power provided to the battery 52. The inverter 56 may invert DC power supplied by the battery 52 via the VVC 10 to AC power for operating each of the electric machines 18 and 24. The inverter 56 may also rectify AC power provided by each of the electric machines 18 and 24 to DC for charging the battery 52. In other examples, the transmission 12 may operate with multiple inverters, such as one invertor associated with each of the electric machine 18 and 24. The VVC 10 includes an inductor assembly 14 (further described in relation to FIG. 2).

The transmission 12 is shown in communication with a transmission control module (TCM) 58 for controlling the electric machines 18 and 24, the VVC 10, and the inverter 56. The TCM 58 may be configured to monitor conditions of each of the electric machines 18 and 24 such as position, speed, and power consumption. The TCM 58 may also monitor electrical parameters (e.g., voltage and current) at various locations within the VVC 10 and the inverter 56. The TCM 58 provides output signals corresponding to this information for other vehicle systems to utilize.

The vehicle 16 may include a vehicle system controller (VSC) 60 that communicates with other vehicle systems and controllers for coordinating operations thereof. Although shown as a single controller, it is contemplated that the VSC 60 may include multiple controllers to control multiple vehicle systems and components according to an overall vehicle control logic or software.

The vehicle controllers, such as the VSC 60 and the TCM 58, may include various configurations of microprocessors, ASICs, ICs, memory (e.g., FLASH, ROM, RAM, EPROM and/or EEPROM), and software code to cooperate with one another to perform vehicle operations. The controllers may also include predetermined data, or "look up tables," which are accessible from the memory and may be based on calculations and test data. This predetermined data may be utilized by the controllers to facilitate control of the vehicle operations. The VSC 60 may communicate with other vehicle systems and controllers (e.g., the BECM 54 and the TCM 58) over one or more wired or wireless connections using bus protocols such as CAN and LIN. The VSC 60 may receive input (PRND) that represents a current position of the transmission 12 (e.g., park, reverse, neutral or drive). The VSC 60 may also receive input (APP) that represents an accelerator pedal position. The VSC 60 may provide outputs representative of a desired wheel torque, desired engine speed, and a generator brake command to the TCM 58; and contactor control to the BECM 54.

The vehicle 16 may include an engine control module (ECM) 64 for controlling the engine 20. The VSC 60 provides output, such as desired engine torque, to the ECM 64 that may be based on a number of input signals including APP and may correspond to a driver's request for vehicle propulsion.

The battery 52 may periodically receive AC energy from an external power supply or grid via a charge port 66. The vehicle 16 may also include an on-board charger 68 which receives the AC energy from the charge port 66. The charger 68 may include AC/DC conversion capability to convert the received AC energy into DC energy suitable for charging the battery 52 during a recharge operation. Although illustrated and described in the context of a PHEV, it is contemplated that the inverter 56 may be implemented with other types of electrified vehicles, such as a FHEV or a BEV.

Figure 2:
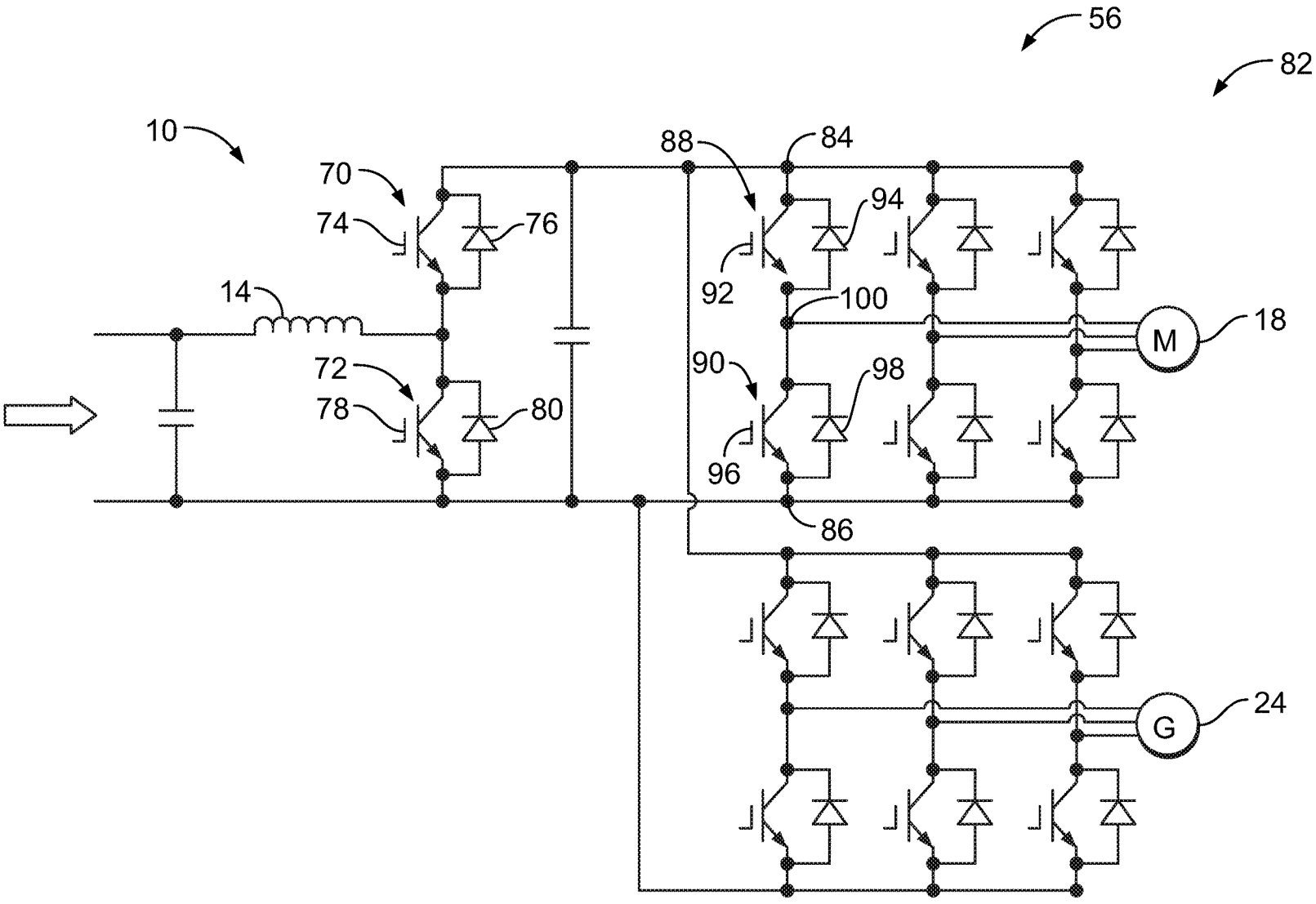
FIG. 2 is a schematic diagram of a variable voltage converter and power inverter.

FIG. 2 illustrates an example of an electrical schematic of the VVC 10 and the inverter 56. The VVC 10 may include a first switching unit 70 and a second switching unit 72 for boosting the input voltage (V_bat) to provide output voltage (V_dc). The first switching unit 70 is shown with a first transistor 74 connected in parallel to a first diode 76 and with their polarities switched (referred to as anti-parallel herein). The second switching unit 72 is shown with a second transistor 78 connected anti-parallel to a second diode 80. Each of the transistors 74 and 78 may be a type of controllable switch (e.g., an insulated gate bipolar transistor (IGBT) or field-effect transistor (FET)). Additionally, each of the transistors 74 and 78 may be individually controlled by the TCM 58. The inductor assembly 14 is depicted as an input inductor that is connected in series between the battery 52 and the switching units 70 and 72. The inductor assembly 14 may generate magnetic flux when a current is supplied. When the current flowing through the inductor assembly 14 changes, a time-varying magnetic field is created and a voltage is induced. Other embodiments of the VVC 10 may include alternative circuit configurations (e.g., more than two switches).

The inverter 56 may include a plurality of half-bridges 82 stacked in an assembly. Each of the half-bridges 82 may be packaged as a power stage. In the illustrated example, the inverter 56 includes six half-bridges (though FIG. 2 labels only one complete half-bridge 82), three for the motor 18 and three for the generator 24. Each of the half bridges 82 may include a positive DC lead 84 that is coupled to a positive DC node from the battery 52 and a negative DC lead 86 that is coupled to a negative DC node from the battery 52. Each of the half bridges 82 may also include a first switching unit 88 and a second switching unit 90. The first switching unit 88 includes a first transistor 92 connected in parallel to a first diode 94. The second switching unit 90 includes a second transistor 96 connected in parallel to a second diode 98. The first transistor 92 and the second transistors 96 may be IGBTs or FETs. The first switching unit 88 and the second switching unit 90 of each of the half-bridges 82 converts the DC power of the battery 52 into a single phase AC output at the AC lead 100. Each of the AC leads 100 is electrically connected to the motor 18 or generator 24. In this example, three of the AC leads 100 are electrically connected to the motor 18 and the other three AC leads 100 are electrically connected to the generator 24.

Components of VVCs and inverters may be heated and/or cooled using a liquid thermal management system, an air thermal management system, or other method as known in the art. In one example of a liquid thermal management system, a thermal plate may be in thermal communication with the components of the VVC or inverter. A system, such as a pressurized system, may control a flow of coolant through the thermal plates to assist in dissipating heat from the components, such as heat generated during a voltage conversion. The thermal management system may be arranged with and/or supported by a power module assembly such that the thermal plates are in thermal communication with the components to facilitate cooling thereof by the coolant.

Figure 3:
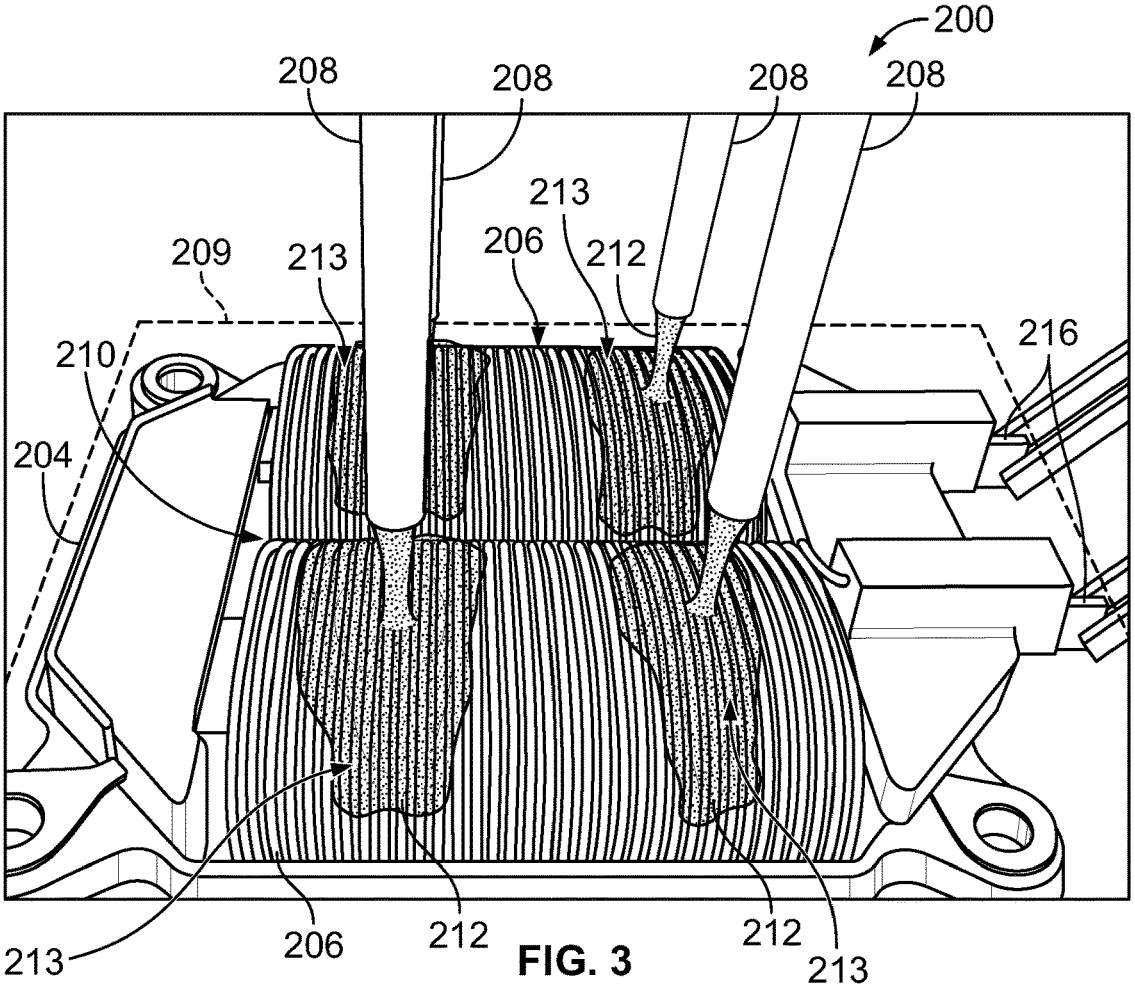
FIG. 3 is a perspective view of a portion of an example of an inductor assembly.
Figure 4:
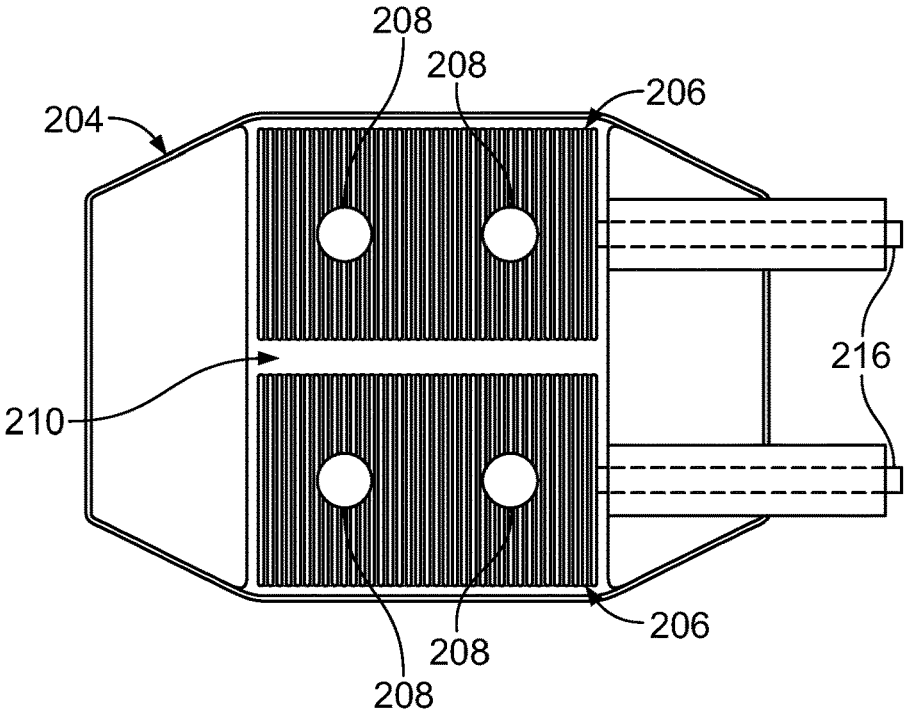
FIG. 4 is a top plan view of the portion of the inductor assembly of FIG. 3.

FIGS. 3 and 4 illustrate an example of a portion of a power inductor assembly, referred to as an inductor assembly 200 herein. The inductor assembly 200 may operate within a vehicle system 202 (shown in FIG. 5B) including a thermal circuit. The inductor assembly 200 may include a housing 204, a pair of coils 206, and one or more distribution conduits 208. The housing 204 and the pair of coils 206 may be sized to fit within a volume defined by a rectangular prism 209. The housing 204 may support the pair of coils 206 and define a cavity 210 sized to receive a portion of each of the pair of coils 206.

Each of the distribution conduits 208 is oriented vertically relative to the pair of coils 206 as shown in FIG. 3. Each of the distribution conduits 208 may be in fluid communication with a coolant pump (not shown in FIGS. 3 and 4) and mounted to a vehicle component located adjacent the pair of coils 206. For example, each of the distribution conduits 208 may be mounted to a portion of a transmission case housing, a portion of a supporting fixture for an electric motor or generator, an inductor, or a VVC housing.

Coolant 212 may flow from each of the distribution conduits 208 and contact a portion of one of the pair of coils 206 to assist in managing thermal conditions thereof. For example, the coolant 212 may contact the pair of coils 206 and cover a predetermined area 213. The predetermined area 213 may be selected based on a portion of the pair of coils 206 in which heat accumulates during operation at a temperature outside of optimal operating conditions. It is contemplated that the coolant 212 may also be distributed to cover all or substantially all of an exterior surface of each of the pair of coils 206. Each of the distribution conduits 208 may be spaced from one of the pair of coils 206 a length approximately equal to a diameter of an opening of the distribution conduit 208. In another example, each of the distribution conduits 308 may be spaced from one of the pair of coils 206 a length approximately equal to half to five times a diameter of an opening of the distribution conduit 208.

Figure 5A:
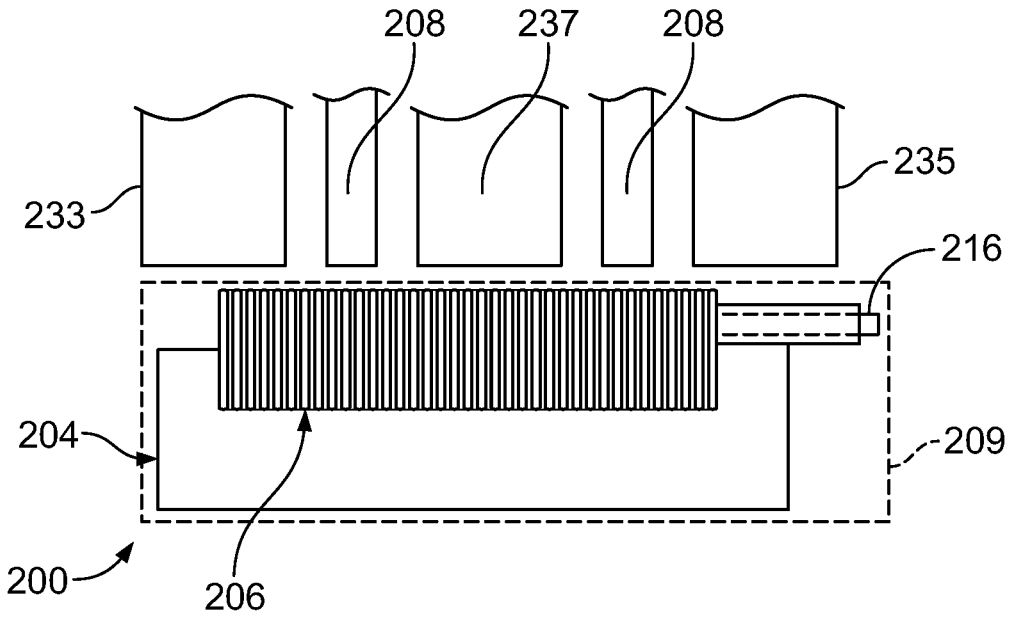
FIG. 5A is a side view of the portion of the inductor assembly of FIG. 3 shown with vehicle components located adjacent thereto.

FIG. 5A further illustrates a locational relationship of the distribution conduits 208 relative to the pair of coils 206 and the rectangular prism 209. For example, one or more vehicle components 233, 235, or 237 may limit available packaging space adjacent the inductor assembly 200. In this example, orienting the distribution conduits 208 vertically relative to the pair of coils 206 provides space for the one or more vehicle components 233, 235, or 237. Examples of the one or more vehicle components 233, 235, or 237 include a portion of a transmission case housing, a portion of a supporting fixture for an electric motor or generator, an inductor, or a VVC housing.

Each of the pair of coils 206 may increase in temperature during operation of the inductor assembly 200. Each of a pair of connectors 216 may be electrically connected to one of the pair of coils 206 to deliver current thereto. The coolant 212 may assist in cooling each of the pair of coils 206 to maintain a temperature within a predetermined threshold to influence optimal operating conditions. While the predetermined threshold may vary based on operating conditions, coolant selection, and the type of coils, in one example, the predetermined threshold may be between −50° Celsius and 220° Celsius. In another example, the predetermined threshold may be between 20° Celsius and 150° Celsius. The distribution conduits 208 may be arranged with the pair of coils 206 to evenly distribute the coolant 212 substantially uniformly upon the pair of coils 206. For example, the coolant 212 may be distributed to substantially cover each of the pair of coils 206. A flow rate of the coolant 212 may be consistent or selectively variable to provide optimal distribution of the coolant 212 to the pair of coils 206.

Figure 5B:
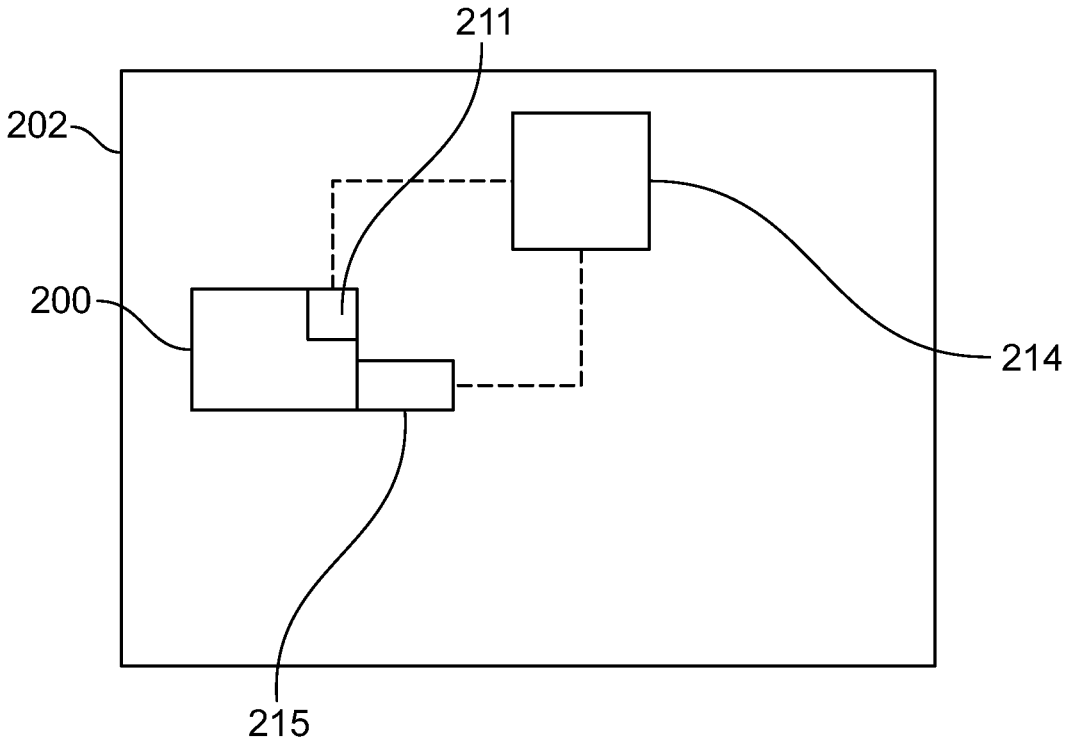
FIG. 5B is a block diagram of an example of an electrified vehicle and control system.

For example and now additionally referring to FIG. 5B, one or more sensors 211 may be in thermal communication with each of the pair of coils 206 of the inductor assembly 200 to monitor conditions thereof. The one or more temperature sensors 211 may transmit monitored temperatures via a signal to a controller 214. The controller 214 may be in communication with a coolant pump 215 to adjust a flow rate of the coolant 212 flowing to the inductor assembly 200 in response to the received signals to maintain optimal thermal conditions of the pair of coils 206, such as maintaining a temperature of the pair of coils 206 within the predetermined threshold. For example, the controller 214 may direct the coolant pump 215 to increase a flow rate of the coolant 212 to the pair of coils 206 in response to receiving a signal from the one or more sensors 211 indicating a temperature of the pair of coils 206 is outside of the predetermined threshold.

A base portion of the cavity 210 may collect the coolant 212 after contact with each of the pair of coils 206. One or more return conduits (not shown) may open to the cavity 210 to remove the coolant 212 collecting therein.

Figure 5C:
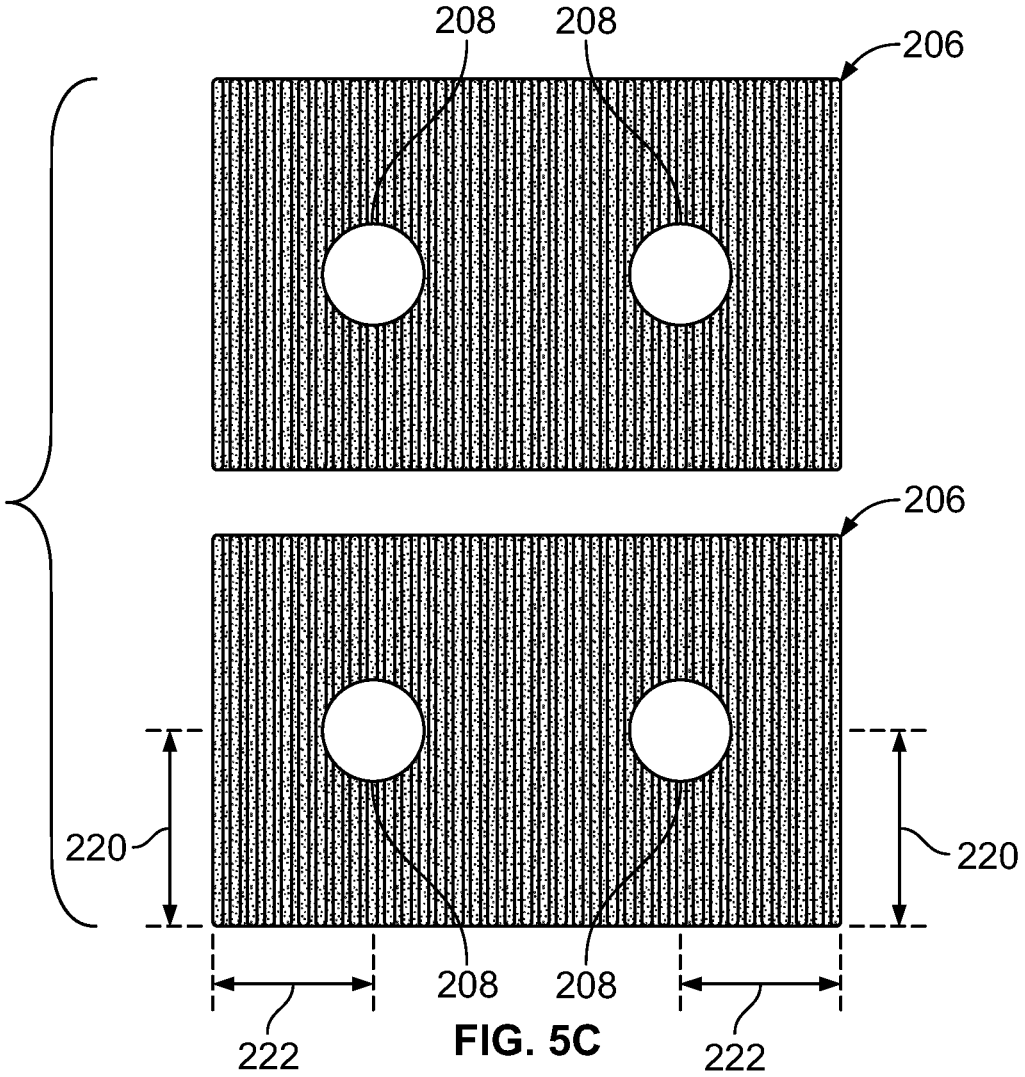
FIG. 5C is a top plan view of the portion of the inductor assembly of FIG. 3 showing an example of distribution conduit locations and coolant flow.

FIG. 5C illustrates spatial relationships between each of the distribution conduits 208 and each of the pair of coils 206. A location of a center point of each of the distribution conduits 208 may be based on a spacing from sides of a respective coil 206. For example, a dimension 220 represents a length between a first side of one of the pair of coils 206 and a center point of one of the distribution conduits 208. In one example, the dimension 220 may be a length between half to three times a diameter of an opening of the distribution conduit. Dimension 222 represents a length between a second side of one of the pair of coils 206 and a center point of one of the distribution conduits 208.

Figure 6:
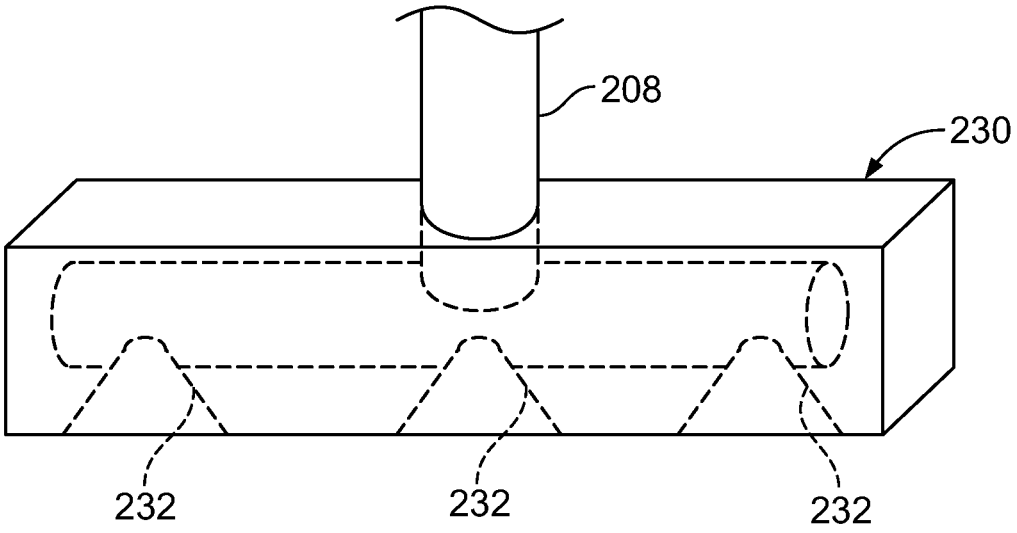
FIG. 6 is a perspective view of an example of an attachment component for a distribution conduit for use with an inductor assembly.
Figure 7:
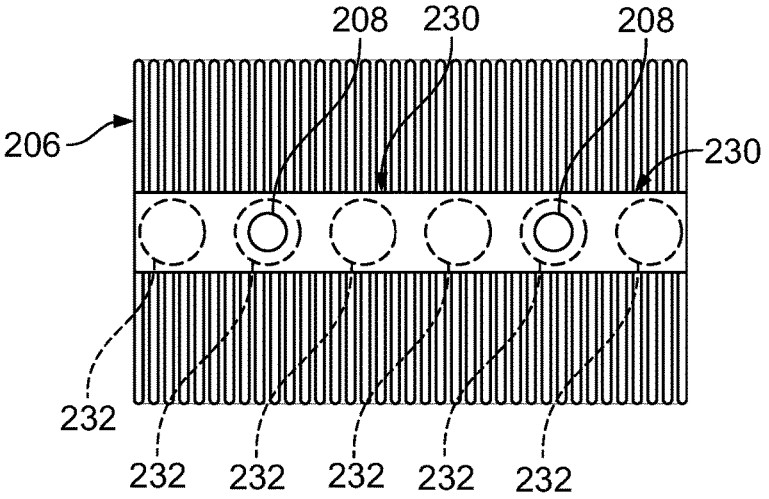
FIG. 7 is a top plan view of the portion of the inductor assembly of FIG. 3 and the attachment component of FIG. 6.

FIGS. 6 and 7 illustrate an example of an attachment 230 for one of the distribution conduits 208 to assist in selectively distributing the coolant 212 to one of the pair of coils 206. The attachment 230 may be arranged with one of the pair of coils 206 to distribute the coolant 212 upon one of the pair of coils 206 to cover a portion or substantially all of the pair of coils 206. For example, the attachment 230 may include one or more openings 232. Various shapes are available for the one or more openings 232 to assist in selectively distributing the coolant 212 upon one or both of the pair of coils 206. In one example, each of the one or more openings 232 may define a cone shape.

Figure 8:
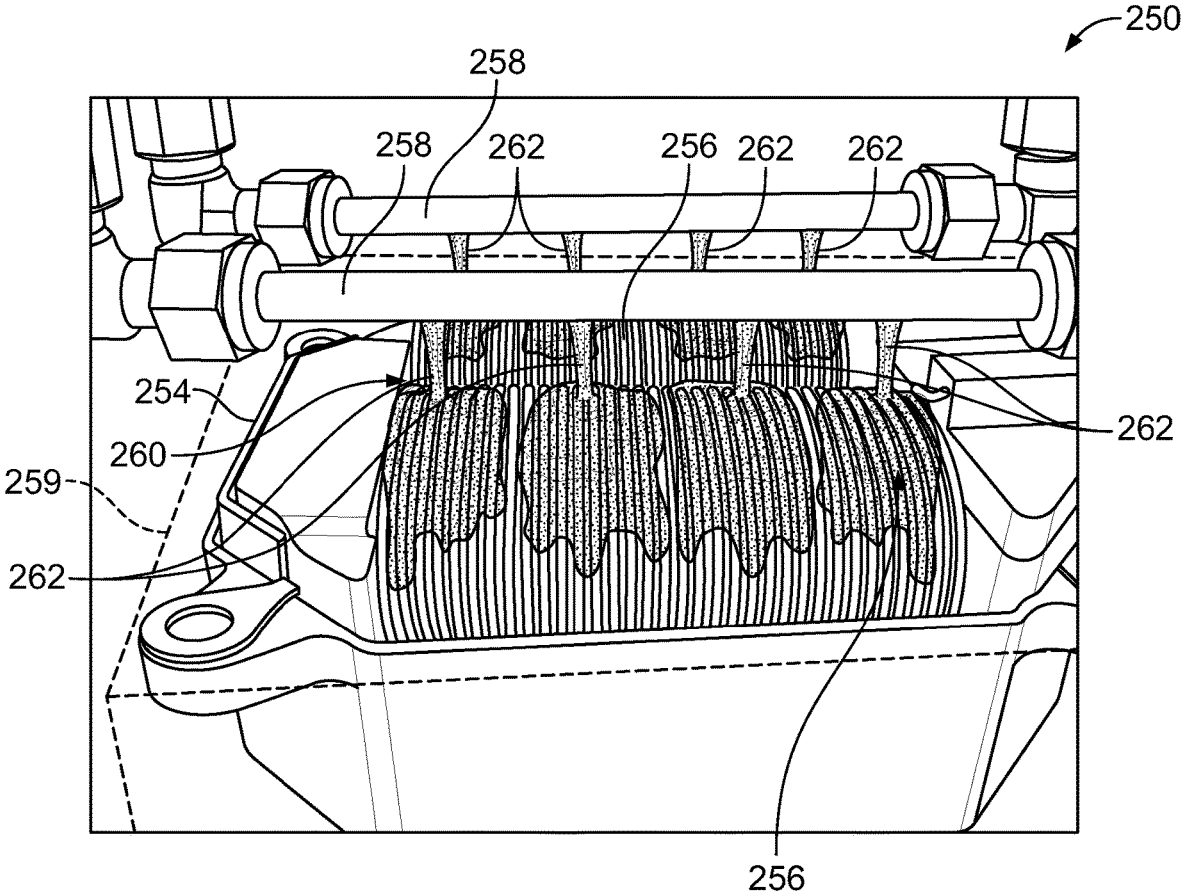
FIG. 8 is a perspective view of a portion of an example of an inductor assembly.
Figure 9:
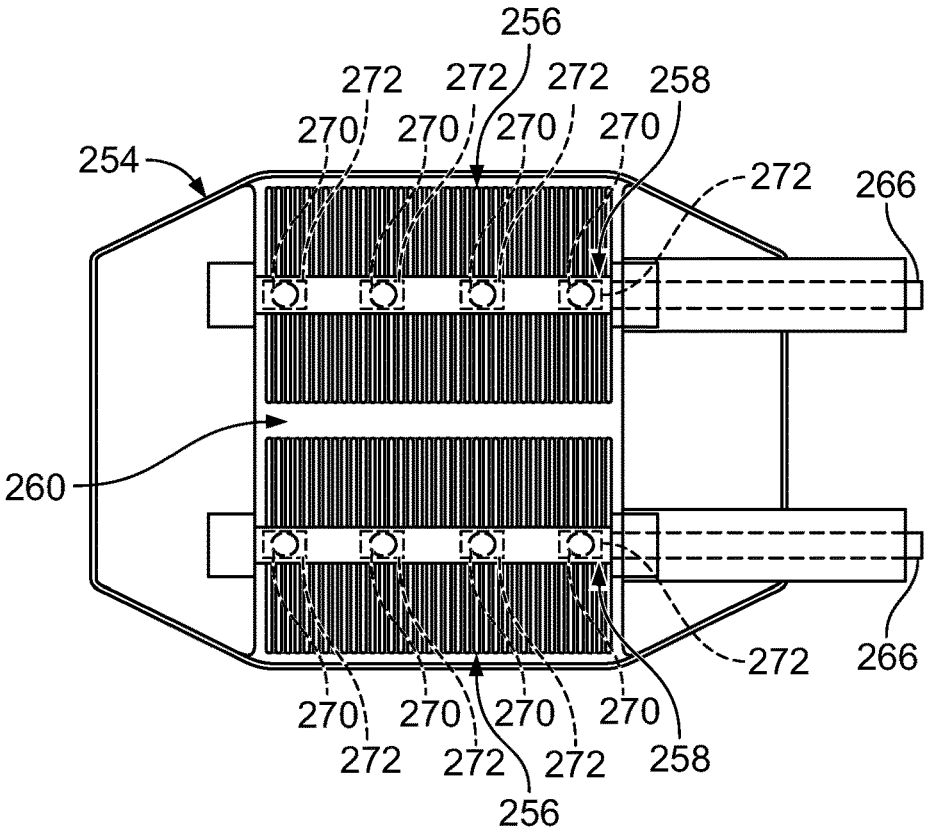
FIG. 9 is a top plan view of the portion of the inductor assembly of FIG. 8.

FIGS. 8 and 9 illustrate another example of a portion of an inductor assembly, referred to as an inductor assembly 250 herein. The inductor assembly 250 may include a housing 254, a pair of coils 256, and one or more distribution conduits 258. The housing 254 and the pair of coils 256 may be sized to fit within a volume defined by a rectangular prism 259. The housing 254 may support the pair of coils 256 and define a cavity 260 sized to receive a portion of the pair of coils 256. Each of the distribution conduits 258 is oriented horizontally relative to the pair of coils 256 as shown in FIG. 8. Coolant 262 may flow from each of the distribution conduits 258 and contact a portion of one of the pair of coils 256 to assist in managing thermal conditions thereof.

For example, each of the pair of coils 256 may increase in temperature during operation of the inductor assembly 250. Each of a pair of connectors 266 may be electrically connected to one of the pair of coils 256 to deliver current thereto. The coolant 262 may assists in cooling each of the pair of coils 256 to maintain a temperature within a predetermined threshold. While the predetermined threshold may vary based on operating conditions, coolant selection, and the type of coils, in one example, the predetermined threshold may be between −50° Celsius and 220° Celsius. In another example, the predetermined threshold may be between 20° Celsius and 150° Celsius. Each of the distribution conduits 258 may define one or more openings to distribute the coolant 262 upon each of the pair of coils 256. In one example, one or more openings 270 may be circular-shaped. In another example, one or more openings 272 may be slot-shaped. Each of the distribution conduits 258 may be spaced from one of the pair of coils 256 a length approximately equal to a diameter of an opening of the distribution conduit 258.

Figure 10:
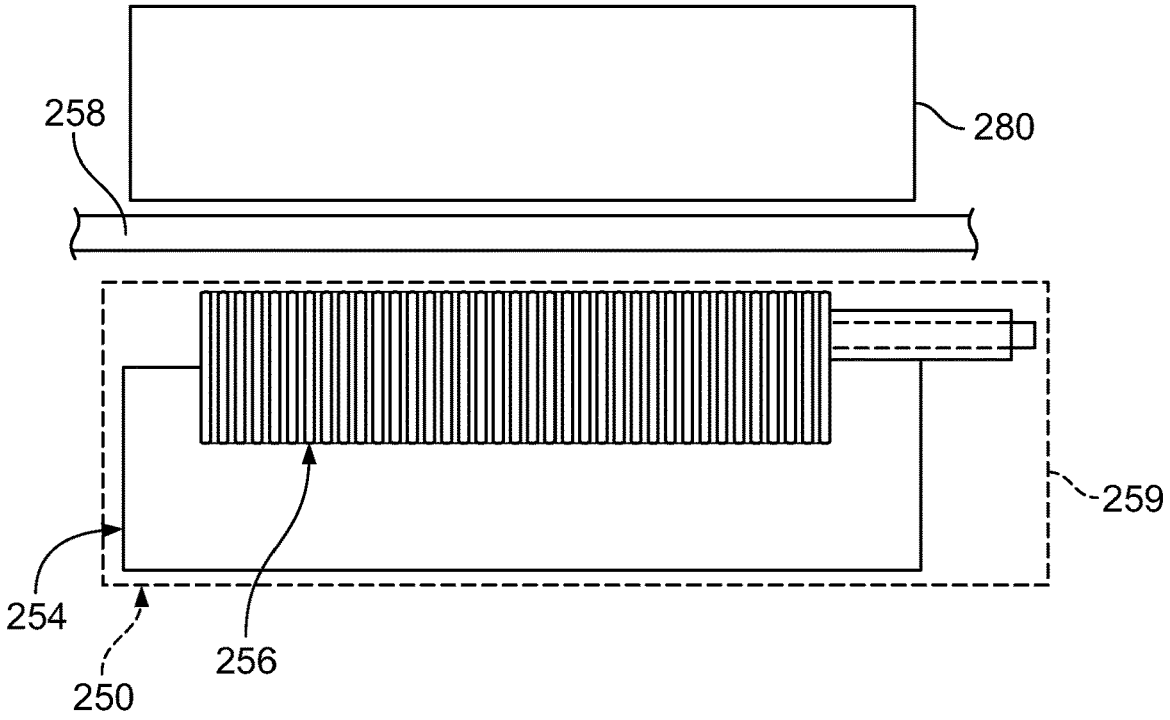
FIG. 10 is a side view of the portion of the inductor assembly of FIG. 8 shown with a vehicle component located adjacent thereto.

FIG. 10 further illustrates a locational relationship of the distribution conduits 258 relative to the pair of coils 256 and the rectangular prism 259. For example, a vehicle component 280 may limit available packaging space adjacent the inductor assembly 250. In this example, orienting the distribution conduits 258 horizontally relative to the pair of coils 256 provides space for the vehicle component 280. Examples of the vehicle component 280 include a portion of a transmission case housing or a portion of a supporting fixture for an electric motor or generator. Optionally, the inductor assembly 250 may include sensors and a controller to selectively activate a coolant pump based on received signals from the sensors as described above.

While various embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to marketability, appearance, consistency, robustness, customer acceptability, reliability, accuracy, etc. As such, embodiments described as less desirable than other embodiments or prior art implementations with respect to one or more characteristics are not outside the scope of the disclosure and can be desirable for particular applications.

What is claimed is:

1. A power inductor assembly comprising:

a power inductor having a housing supporting a pair of coils;

a vehicle component located above the pair of coils; and a pair of distribution conduits, each defining a first opening area and oriented vertically relative to one of the pair of coils below the vehicle component and having an attachment mounted to an end of at least one distribution conduit, wherein the attachment includes one or more conical openings defining a second opening area greater than the first opening area adjacent the coils to distribute coolant thereto.

2. The assembly of claim 1, wherein each of the one or more openings defines one of a circular shape and a slot shape.

3. The assembly of claim 1, wherein each of the one or more openings is sized such that exiting coolant substantially uniformly covers the adjacent coil.

4. The assembly of claim 1, wherein each of the pair of distribution conduits is spaced from one of the pair of coils a length approximately equal to half to five times a diameter of one of the one or more openings.

5. The assembly of claim 1, wherein the vehicle component is one of a portion of a transmission case housing, a portion of a supporting fixture for an electric motor or generator, the power inductor, and a variable voltage controller housing.

6. The assembly of claim 1, wherein the power inductor defines a rectangular prism, and wherein each of the pair of coils is located above the rectangular prism and below the vehicle component.

7. The assembly of claim 1, wherein the coolant is one of engine oil, transmission oil, and engine coolant.

8. A power inductor assembly comprising:

a power inductor including a housing supporting a pair of coils; and two distribution conduits oriented vertically relative to the coils, wherein each of the distribution conduits defines a first opening area and is arranged with one of the coils such that coolant exiting the distribution conduit passes through an attachment mounted to an end of at least one distribution conduit and is expelled through a plurality of conical openings of the attachment, each conical opening defining a second opening area larger than the first opening area such that the expelled coolant covers a first predetermined area of one of the pair of coils.

9. The assembly of claim 8, wherein the first predetermined area is further defined as an area substantially uniformly covering one of the pair of coils.

10. The assembly of claim 8 further comprising:

a third distribution conduit spaced from one of the two distribution conduits and oriented vertically relative to one of the pair of coils for coolant distribution thereupon; and a fourth distribution conduit spaced from an other of the two distribution conduits and oriented vertically relative to the other of the pair of coils for coolant distribution thereupon.

11. The assembly of claim 8 further comprising:

a coolant pump in fluid communication with one of the two distribution conduits;

a sensor in communication with one of the pair of coils to monitor thermal conditions thereof; and a controller in communication with the sensor to receive signals including the monitored thermal conditions and in communication with the coolant pump to direct operation thereof based on the monitored thermal conditions.

12. The assembly of claim 8 further comprising a vehicle component, wherein the pair of coils and the housing are sized for locating within a rectangular prism and the vehicle component is located outside of the rectangular prism, and wherein the distribution conduits are arranged with the vehicle component to provide the coolant to the pair of coils without contacting the vehicle component.

13. A power inductor assembly comprising:

a power inductor including a pair of coils to generate energy to assist in powering a vehicle; and an inductor thermal management system including a coolant circuit in fluid communication with a pair of distribution conduits each spaced above one of the pair of coils and an attachment mounted to an end of at least one of the distribution conduits, the attachment defining a plurality of conical openings, wherein each of the pair of distribution conduits defines a first opening area for delivering coolant to the attachment, and the attachment defines a second opening area greater than the first opening area to expel coolant directly upon one of the pair of coils and is spaced away from a respective one of the coils.

14. The assembly of claim 13, wherein each of the pair of distribution conduits is oriented vertically relative to one of the pair of coils such that each of the openings is arranged with the one of the pair of coils to distribute coolant substantially uniformly thereupon.

15. The assembly of claim 14, wherein each of the pair of distribution conduits is oriented vertically relative to one of the pair of coils such that clearance is provided for locating a vehicle component on an outer side of each of the distribution conduits and above the pair of coils.

16. The assembly of claim 13, wherein each of the pair of distribution conduits is oriented horizontally relative to one of the pair of coils such that each of the openings is arranged with the one of the pair of coils to distribute coolant substantially uniformly thereupon.

17. The assembly of claim 16, wherein each of the pair of distribution conduits is oriented horizontally relative to one of the pair of coils to provide space for locating a vehicle component above the pair of distribution conduits and a rectangular prism region defined by the power inductor.

18. The assembly of claim 13, wherein the coolant is one of engine oil, transmission oil, and engine coolant.

* * * * *